United States Patent [19]

Farley et al.

[11] 4,203,096

[45] May 13, 1980

[54] SENSOR MONITORING ALARM SYSTEM

[75] Inventors: Max F. Farley; Edmund L. Dutton, both of Marietta, Ohio

[73] Assignee: Mallinckrodt, Inc., St. Louis, Mo.

[21] Appl. No.: 896,364

[22] Filed: Apr. 6, 1978

[51] Int. Cl.[2] ..... G08B 25/00

[52] U.S. Cl. ..... 340/538; 340/521; 340/533

[58] Field of Search ..... 340/147 PC, 150, 151, 340/171 R, 182, 183, 203, 505, 506, 531, 533, 534, 538, 517, 521; 179/2 AM, 15 BL, 15 AL

[56] References Cited

U.S. PATENT DOCUMENTS

| | | | |
|---|---|---|---|
| 2,406,165 | 8/1946 | Schroeder | 179/15 AL |
| 2,701,748 | 4/1954 | Anderson | 346/34 |
| 2,723,309 | 11/1955 | Lair et al. | 179/15 AL |
| 3,510,841 | 5/1970 | Lejon | 340/151 |
| 3,697,984 | 10/1972 | Atkinson et al. | 340/505 |
| 4,044,351 | 8/1977 | Everson | 340/533 |
| 4,053,714 | 10/1977 | Long | 340/183 |

*Primary Examiner*—Alvin H. Waring
*Attorney, Agent, or Firm*—Cushman, Darby & Cushman

[57] ABSTRACT

A time multiplexed sensor monitoring system. A plurality of remote sensor units are connected to a central control unit by a two-wire bus line. Power is supplied to the remote unit sensors by the central control unit. Synchronization of the remote units is provided through momentary interruptions in the power supplied to the remote sensor units. The use of a single two-wire bus line for both application of DC signals to the respective remote sensor units and communication of data from the remote sensor units to the central control unit is facilitated by use of double tone multi-frequency (DTMF) signalling techniques.

16 Claims, 6 Drawing Figures

SENSOR MONITORING ALARM SYSTEM

BACKGROUND OF THE INVENTION

The present invention relates to alarm monitor systems, and in particular to monitor systems wherein a plurality of remote sensor units communicate in a time multiplexed fashion with a central control unit.

Alarm monitoring systems wherein a central control unit communicates with a plurality of remote sensor units are in general well known. Such prior art alarm monitoring systems, however, generally utilize separate transmission lines between the central control unit and the respective remote sensor units, complex interrogating schemes or both. An example of such systems is described in U.S. Pat. No. 3,697,984, issued Oct. 10, 1972 to Atkinson.

To avoid the necessity of complex interrogation schemes in two-wire bus communication systems, sequential addressing of respective transponders along the bus has been achieved in various systems by generation by the central control unit of a single interrogation pulse to which each of the transponders is responsive and interjecting delays into the bus line between the respective transponders. Examples of such systems are described in U.S. Pat. No. 2,723,309 issued Nov. 8, 1955 to Lair et al and U.S. Pat. No. 3,510,841 issued May 5, 1970 to Lejon.

A communication system utilizing a two-wire bus, wherein a plurality of stations connected to the bus communication with each other in a time multiplex fashion, is described in U.S. Pat. No. 2,406,165 issued Aug. 20, 1946 to Schroeder. A synchronization pulse is generated on the bus line, to which all of the stations are responsive. Each station includes a sequence of multivibrators (one shots) which are triggered in response to the synchronization pulse to enable the respective station receivers during different sequential time periods. Communication between stations is effected by generating pulse amplitude modulated pulses during the time period associated with the enabling of the receiver in the desired (called) station.

In a sensor monitoring system it is desirable that the system be open-ended, that is, amenable to addition of further sensor units, and further, that the sensor units require no external source of power. An example of such system is disclosed in U.S. Pat. No. 4,053,714 issued Oct. 11, 1977 to Long. In the Long system a plurality of sensor units communicate with a single receiver over a two-wire bus line in a time multiplexed fashion. Each sensor unit includes a crystal controlled clock, and a rechargeable power source (nickle-cadmium battery). A central power supply connected to the bus line periodically applies a charging pulse of current to recharge the batteries in the respective transmitters. The charging pulse provides a peak pulse battery charging current of about 1.5 amp. over a recharging interval of about one second. The recharging pulse is also utilized to reset the respective clocks of the transmitters. The clocks selectively enable the transmitters during respective periods in a predetermined time sequence, whereupon the transmitter transmits a bipolar pulse code message to the receivers. After transmission, the transmitter is effectively disconnected from the bus line until the clock associated therewith is reset by the next recharging pulse.

It should be appreciated that the relatively high currents of the charging pulse sets a limit on the minimum gauge of the bus line wires. Further, the use of high speed digital pulse codes (on the order of 500 BPS) requires use of either coaxial cable or shielded wire to prevent high frequency radiation and/or distortion.

It is desirable to provide an open-ended two-wire bus line sensor monitor system which can utilize relatively inexpensive wire (e.g., Class II) rather than shielded wire or coaxial cable as required in systems utilizing high bit rate digital pulse coding techniques. Dual-Tone multi-frequency (DTMF) modulation techniques are well known in telephony systems as an alternative to digital pulse techniques and have been suggested for use in computer signalling and control system applications.

SUMMARY OF THE INVENTION

The present invention provides an open-ended multiplexed sensor monitor system of the type wherein a central control unit is connected to a plurality of remote sensor units through a two-wire bus line which can be formed of inexpensive wire. A relatively low current DC signal is applied over the bus line by the central control unit. Each remote sensor unit is powered by the DC voltage, and includes means for controllably generating a code signal on the bus line indicative of a sensed condition. The DC signal to the remote units is periodically interrupted, and the interruption sensed by the respective remote sensor units to selectively effect transmission of the respective code signals (data bytes) in sequence. Dual-tone multi-frequency (DTMF) coding techniques are utilized such that, when in combination with the low voltage DC signals, inexpensive wire can be utilized for the bus line. Further, since dual-tone multi-frequency coding entails the use of known discrete frequencies for the data transport medium, superior rejection of spurious transient noise pickup can be obtained. Further, use of the audio tones permits the use of split winding iron core transformers for coupling the remote units to the bus.

In accordance with another aspect of the invention, the central control unit includes a memory containing respective high and low acceptable value limits for each of the conditions sensed by the remote sensor units. As data from the respective remote sensor units are received by the central control unit, each data byte is compared to the high and low limit values associated therewith. When the data byte deviates from the acceptable band of values, an alarm is triggered.

BRIEF DESCRIPTION OF THE DRAWINGS

A preferably exemplary embodiment will hereinafter be described in conjunction with the following drawings wherein like numerals denote like elements, and.

BRIEF DESCRIPTION OF AN EXEMPLARY PREFERRED EMBODIMENT

Figure 1:
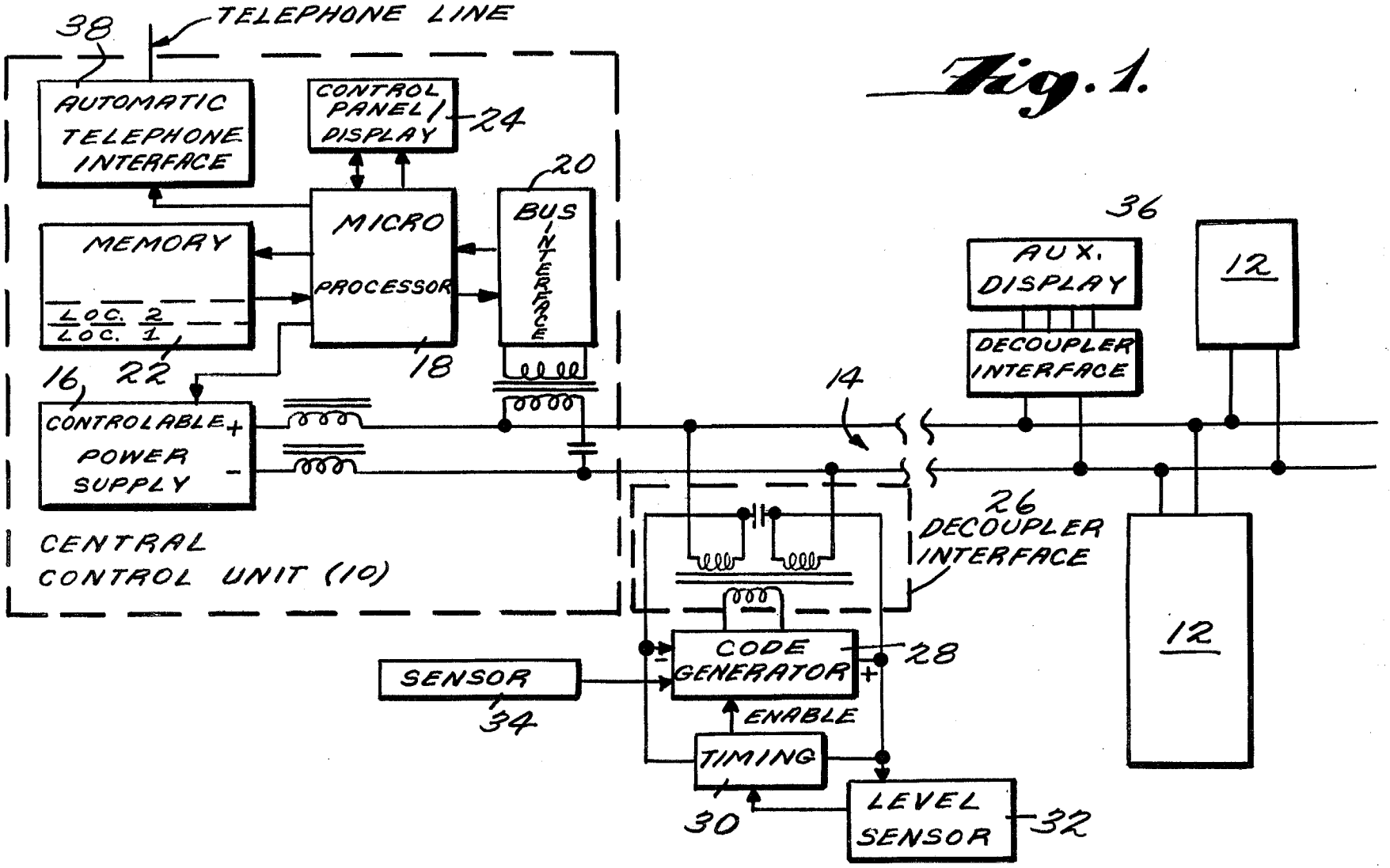
FIG. 1 is a schematic block diagram of a sensor monitoring system in accordance with the present invention.
Figure 2:
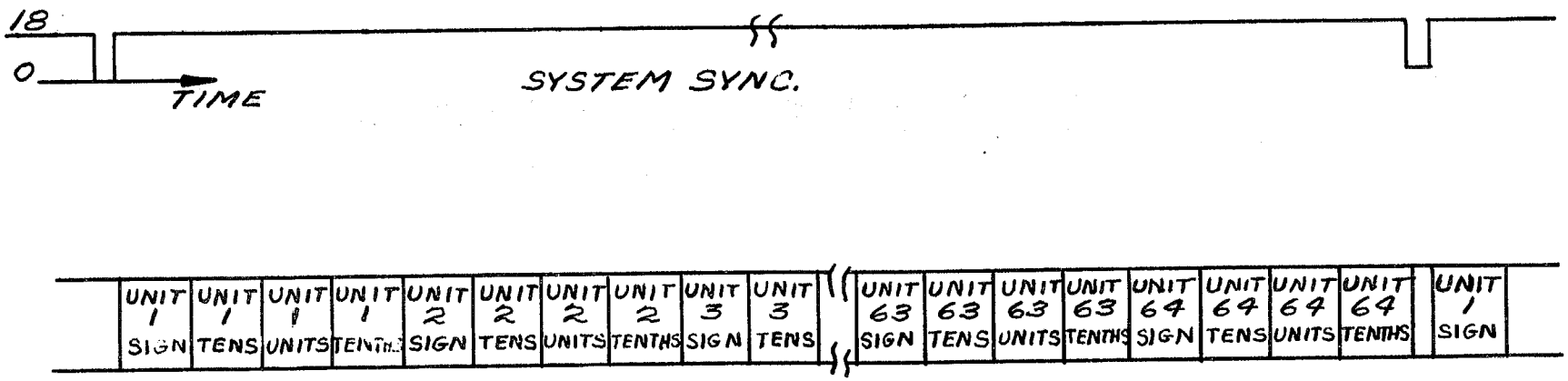
FIG. 2 illustrates the data format of the audio frequency signals on the bus line.

Referring now to FIGS. 1 and 2, a central control unit 10 communicates with a plurality of remote units 12 over a two-wire bus line 14.

Central control unit 10 suitably includes a controllable power supply for generating a DC signal on bus line 14, suitable control logic for micro-processor 18, a bus interface 20 inductively coupled to bus line 14 and communicating with micro-processor 18, a memory 22 associated with micro-processor 18 and a control panel/display 24.

Each remote sensor unit 12 is coupled to bus line 14 through a decoupler interface 26, which decouples the DC power from the bus line for application to a code generator portion 28 and timing circuitry portion 30 of remote sensor unit 12 and inductively couples the data bytes from code generator 28 to bus line 14. A level sensor 32 is also responsive to the DC signal applied on bus line 14 and generates the reset signal to timing circuitry 30, as will be explained. Remote unit 12 also includes a conventional sensor device 34, which cooperates with code generator 28. Remote unit 12 will be described in more detail in conjunction with FIG. 3.

In operation, controllable power supply 16 under the control of micro-computer 18 provides a DC power signal along bus line 14. Supply 16, normally derives the DC signal from standard 120 volt AC power lines, but suitably also includes standby batteries to provide power to all remote sensors via bus line 14 in the event of a loss of commercial power. The DC signal is extracted by (each) decoupler 26 and utilized to power the remainder of remote sensor unit 12.

In the generation of sensor data signals representative of the condition sensed by remote sensor unit 12, sensor 34 generates an analog signal representative of the condition which is applied to code generator 28. Code generator 28 samples the analog signal and generates a corresponding digital signal suitably in binary coded decimal (BCD) form. The BCD signal is converted into a dual-tone-multi-frequency (DTMF) code, wherein each digit is represented by a tone pair comprising one tone from a low frequency group (suitably 697 Hz, 770 Hz, 852 Hz, and 941 Hz) and one tone from a high frequency group (suitably 1209 Hz, 1336 Hz, 1477 Hz and 1633 Hz). When enabled, code generator 28 generates, in sequence, the respective tone pairs representative of the sign and respective digits of the BCD representation of the sample onto bus line 14.

It should be appreciated that the DTMF signalling techniques utilized do not interfere with the low voltage DC signal on bus line 14 (and thus allows utilization of inexpensive wire, e.g., class 2, for the bus line). DC decoupling is easily effected by use of split winding iron core transformers for decoupling interface 26. Shielded wire or coaxial cable is not required in view of the DTMF signalling techniques utilized. Further, the respective frequencies utilized in the tones are chosen to be nonharmonically related to avoid spurious signal generation. Moreover, since the data is transmitted in the form of known discrete frequencies, superior rejection of unwanted transient noise is obtained.

Each data cycle is initiated by momentarily interrupting the DC signal on bus line 14. In response to the interruption, the respective level sensors 32 in the respective remote units 12 generate reset signals to timing circuitry 30. The respective timing circuits 30 then enable the code generators at respective time intervals preset into the respective units, suitably by setting an assigned unit number on switches incorporated into timing circuitry 30. Thus, the respective remote units transmit data onto bus line 14 in a time multiplexed manner. The time relation of the momentary interruption in DC signal and data frame are shown in FIG. 2.

The DTMF code signals are extracted from bus line 14 by bus interface 20. The DTMF signals are suitably prevented from reaching power source 16 by conventional choke inductors. Bus interface 20 suitably converts each DTMF data byte into a digital signal which is applied to micro-processor 18 for processing. Bus interface 20 will be hereinafter described in more detail in conjunction with FIG. 4.

Micro-processor 18 receives the data bytes in sequence and stores them in assigned locations in memory 22. Thereafter, each of the sensor data bytes are compared to high and low limit values which were preset into assigned locations in memory 22 by the console operator. When micro-processor 18 detects a data byte from a given sensor unit not within acceptable limits as delimited by a preset limit value, an audible alarm is triggered and a light energized on the control panel to indicate the particular remote unit generating deviant data byte. The operator console will be explained in more detail in conjunction with FIG. 5.

It should also be appreciated that auxiliary display units 36 can be coupled into the system anywhere along the bus line 14. Such units are inductively coupled into the line and include internal timing circuits similar to timing circuit 30 of the remote units 12, responsive to the periodic DC signal interruptions. The unit suitably includes provisions for display of the measured value of the respective remote units 12. If desired, auxiliary displays 36 can derive power from external sources rather than extracted power from bus line 14.

In addition, a telephone adapter unit 38 can be included in central control unit 10 to provide direct access to cognizant personnel. In the event of an alarm, the telephone adapter 38 suitably will automatically dial a predetermined number of telephone numbers in a predetermined order and send digital messages via the telephone system. A special remote readout at the called location will provide indicia of the nature of the alarm.

Figure 3A:
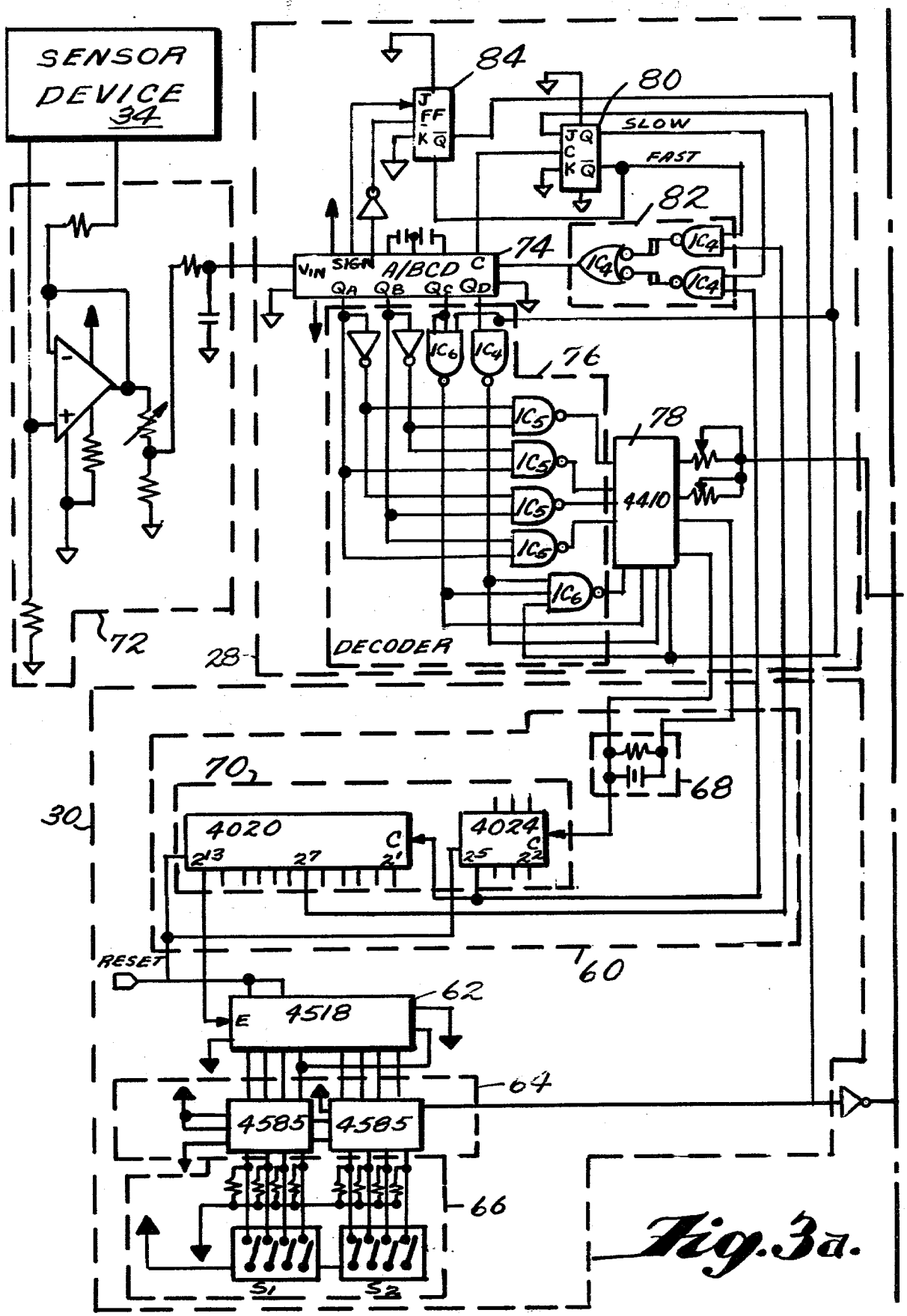
FIGS. 3*a* and 3*b* are schematic diagrams of a remote sensor unit.
Figure 3B:
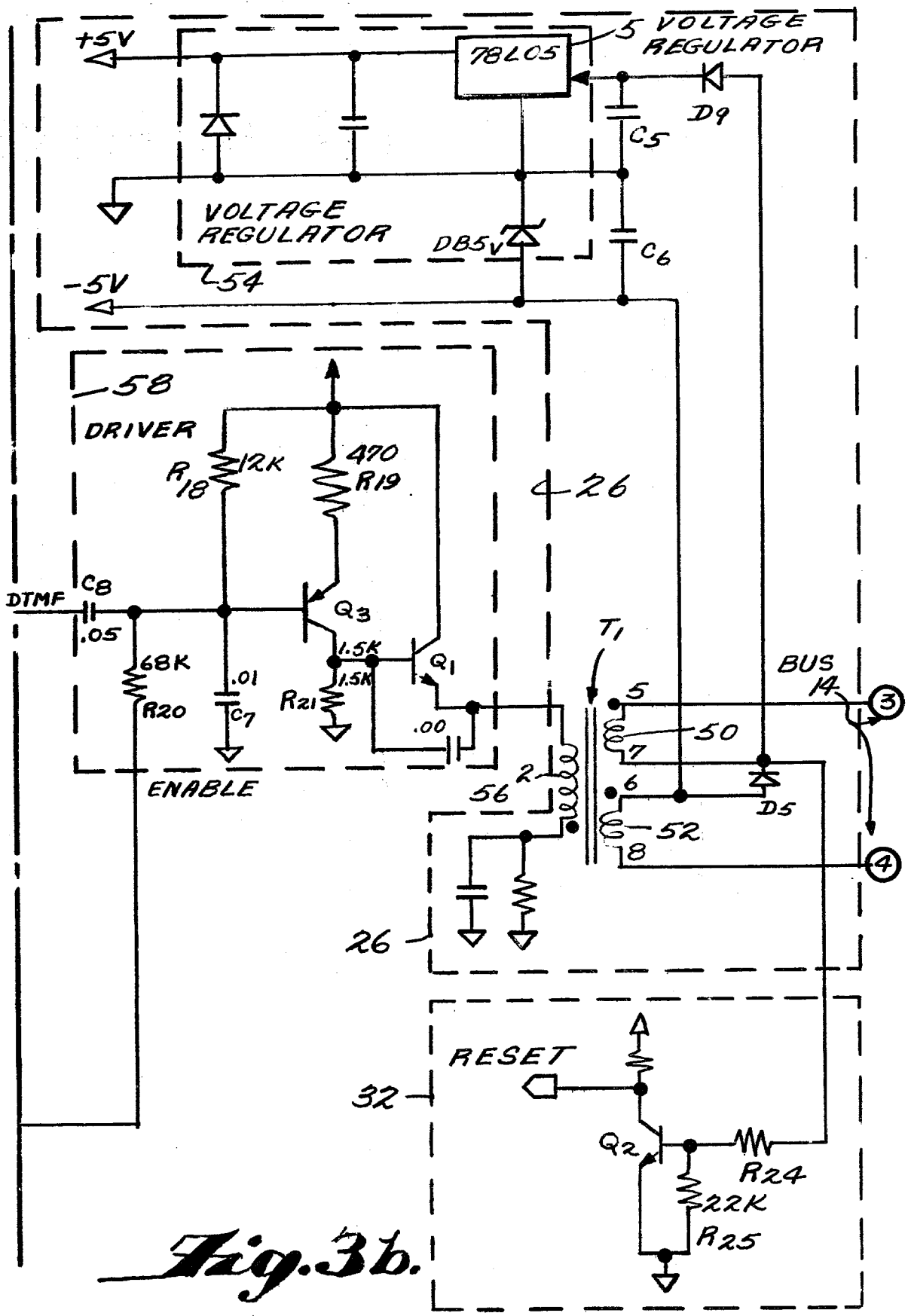

Referring now to FIG. 3, there is shown a suitable remote sensor unit. As previously noted, sensor 12 is coupled to bus line 14 through a decoupler interface 26. Decoupler interface 26 preferably comprises a split winding iron core transformer T1. The respective split windings 50 and 52 are each coupled at one terminal (positive and negative, respectively) to the respective wires of bus line 14, and at the other terminals across a capacitance, suitably comprising capacitors C5 and C6. More specifically, the negative terminal of winding 50 is coupled through a diode D9 to one terminal capacitor C5, the other terminal of which is connected to ground potential. The positive terminal of winding 52 is connected to one terminal of capacitor C6, the other terminal of which also being coupled to ground. The positive terminal of winding 52 is also connected through a diode D5 to the negative terminal of winding 50. Thus, a voltage is developed across capacitors C5 and C6, in accordance with DC signal on bus line 14. A voltage regulator 54 is coupled across capacitrs C5 and C6 to develop plus five (30 5) and minus five (−5) volts regulated voltages.

The time constants of decoupler interface 26 are chosen such that after the initial charging of capacitors C5 and C6 the periodic interruptions in the DC signal on bus line 14 do not cause substantial discharge of the capacitors. Thus, code generator 28 and timing circuitry 30 portions of the remote unit 12 are provided with a constant and uninterrupted supply voltage.

The primary winding 56 of transformer T1, inductively coupled to windings 50 and 52, is electrically connected to a suitable driver circuit 58. Driver circuit 58 is suitably an amplifier which is enabled for a predetermined period by application of a suitable enable signal, as will be explained.

As noted above, a level sensor 32 is also receptive of the DC signal on bus line 14. More specifically, level sensor 32 is suitably a normally saturated transistor Q2 having a base connected to the negative terminal of winding 50 of transformer T1. Momentary interruptions in the DC signal on bus line 14 cause transistor Q2 to cut off, thus generating a reset signal at the collector thereof.

The reset signal from level detector 32 is applied to timing circuitry 30. Timing circuitry 30 suitably comprises a clock signal generator 60, a counter 62, a digital comparator 64, and a set of programming switches 66. Clock signal generator 60 suitably comprises a crystal oscillator 68 and a chain of binary dividers 76. Crystal oscillator 68 may, in practice, be partially or totally incorporated in the DTMF encoder utilized in code generator 28, as will be explained.

A code number indicative of the respective sequential period assigned to the given remote unit 12, e.g., the unit number, is entered on programming switches 66, which make appropriate connections to generate a corresponding signal to digital comparator 64. Digital comparator 64 (and counter 62) are suitably binary coded decimal (BCD) devices to facilitate entering the time period information. Upon reception of the reset signal, divider chain 70 of clock signal generator 68 and counter 62 are reset and thereafter being counting up from zero. Counter 62 is incremented with each clock signal from clock signal generator 60, until such time as the BCD count therein is equal to the programmed count from switches 66. At that point, digital comparator 64 generates an enable signal to driver 58. The enable signal is also applied to code generator 28 to initiate an output mode as will hereinafter be explained.

Sensor device 34 is coupled through a suitable signal conditioner 72 to code the generator 28. Sensor device 34 can be any suitable device which generates a signal representative of a sensed condition. By way of non-limiting example, a platinum resistance probe, RTD, or other thermistor (with appropriate biasing provisions) can be utilized to sense temperature. Similarly, commercial sensors are available for measurement of humidity, and $CO_2$ percentage. Sensor device 34 can also be chosen for monitoring the operation of machinery and could, for example, be a tachometer for measurement of revolutions per minute, or the like.

Signal conditioner 72 is suitably an amplifier or attenuator which operates as an interface between the particular sensor 34 and decoder 28, converting the output signal of the sensor into a form compatible with the code generator circuitry. Where the output signals of sensor 34 are compatible with the code generator circuitry, signal conditioner 72 may be omitted.

The conditioned analog signal from signal conditioner 72 is applied to the input terminal of an analog to BCD converter 74, suitably a Siliconix LD130 chip. Analog to BCD converter 74, in effect, samples the analog input signal in accordance with a clock signal applied to the clock input thereof and internally stores the sample. Thereafter, upon command, analog-to-BCD converter 74 suitably provides respective four (4) bit ($Q_A$, $Q_B$, $Q_C$, $Q_D$) outputs, during distinct sequential predetermined time periods, representative of the sign and first, second and third digits of the BCD representation of the sample, respectively.

More specifically, when comparator 64 generates the enable signal to driver 58, the enable signal is also applied to a flip-flop 80, which controls the clock signal to the analog to BCD converter 74 in cooperation with a decoder 82. After reset of binary dividers 70 and counter 62, sampling of the analog input is effected by analog-to-BCD converter 74 at a first relatively fast clock rate. This is achieved by application of the output of a first stage of binary divider 70 through decoder 82 to converter 74. However, the enable signal from comparator 64 toggles flip-flop 80, causing decoder 82 to apply a slower clock signal derived from a later stage of divider 70. Application of the slower clock pulse causes analog-to-BCD converter 74 to assume an output mode whereupon the sign and three digits of data are sequentially outputted.

The BCD digits (and sign) are transmitted in sequence through a suitable decoder 76 to effect generation of a corresponding DTMF tone pair by a conventional crystal controlled DTMF encoder 78, such as a Motorola MC114410 chip. DTMF encoder 78 generates a DTMF output signal which represents each BCD digit as a pair of tones, one selected from a predetermined group of high frequencies and the other selected from a predetermined group of low frequencies. The tone pairs are addressed by "matrix" techniques, whereby, in effect, the respective low frequencies are arranged as rows ($R_1$, $R_2$, $R_3$, $R_4$) and the high frequencies as respective columns ($C_1$, $C_2$, $C_3$, $C_4$) in a matrix. Thus, generation of a particular pair by DTMF encoder 78 is effected by providing an appropriate signal to a given row input and a given column input of encoder 78. Decoder 76, in effect, translates the BCD digital into the appropriate matrix input signals to generate a desired tone pair.

Commercial DTMF systems, and hence the available DTMF detectors (such as the Rockwell-Collins CRC8030) have adopted a particular coding convention (presumably in accordance with the standard Touch-Tone key board) whereby detection of a particular tone pair effects the generation of a particular binary output. Adoption of the standard coding convention, would thus entail the use of a corresponding decoder 76. Other coding conventions where other than the standard decoder are utilized, require conversion circuits in addition to a DTMF detector, if standard commercial DTMF detectors are to be used. In a time multiplexed sensor monitoring system, however, a large plurality of remote units, and hence a large plurality of DTMF encoders, communicate with a single DTMF decoder in the central control unit 10. Accordingly, it is desirable to utilize as simple a decoder 76 as possible. The preferred coding convention allowing use of a simple decoder 76 is set out in Table I:

TABLE I

| INPUT DATA | BCD DIGIT $Q_A$, $Q_B$, $Q_C$, $Q_D$ | DTMF ENCODER INPUT ROW | DTMF ENCODER INPUT COL. | TONE PAIR GENERATED $f_L$ | TONE PAIR GENERATED $f_H$ | COMMERCIAL DTMF DETECTOR BINARY OUTPUT $D_8$, $D_4$, $D_2$, $D_1$ | STANDARD CONVENTION OUTPUT DATA |
|---|---|---|---|---|---|---|---|
| 0 | 0000 | 1 | 1 | 697 | 1209 | 0001 | 1 |
| 1 | 1000 | 2 | 1 | 770 | 1209 | 0100 | 4 |
| 2 | 0100 | 3 | 1 | 852 | 1209 | 0111 | 7 |
| 3 | 1100 | 4 | 1 | 941 | 1209 | 1011 | * |
| 4 | 0010 | 1 | 2 | 697 | 1336 | 0010 | 2 |
| 5 | 1010 | 2 | 2 | 770 | 1336 | 0101 | 5 |
| 6 | 0110 | 3 | 2 | 852 | 1336 | 1000 | 8 |
| 7 | 1110 | 4 | 2 | 941 | 1336 | 1010 | 0 |
| 8 | 0001 | 1 | 3 | 697 | 1477 | 0011 | 3 |
| 9 | 1001 | 2 | 3 | 770 | 1477 | 0110 | 6 |
| (+) | 00XX | 1 | 4 | 697 | 1633 | 1101 | A |
| (+) | 10XX | 2 | 4 | 770 | 1633 | 1110 | B |
| (+) | 01XX | 3 | 4 | 852 | 1633 | 1111 | C |
| (+) | 11XX | 4 | 4 | 941 | 1633 | 0000 | D |

The "X" designations shown in the BCD bits $Q_C$ and $Q_D$, relating to the plus sign indicate that with respect to the representation of the sign of the sample, only bits $Q_A$ and $Q_B$ contain relevant data and the state of bits $Q_C$ and $Q_D$ are irrelevant. This derives from the adoption of the convention whereby a positive sign is represented by the generation of a particular high frequency (1633 Hz). Analog-to-BCD converter 74 provides an indication of the sign at a particular output terminal (pin 5) other than the $Q_A$, $Q_B$, $Q_C$, $Q_D$ output terminals. The sign output signal is applied as a control signal to a flip-flop 84. The $\overline{Q}$ output signal of flip-flop 84 is utilized to effectively inhibit application of signals to the input terminals corresponding to columns 1, 2 and 3 of DTMF encoder 78, while at the same time applying a signal to the column 4 input (corresponding to 1633 Hz). It should be noted that the frequency 1633 is in effect, a spare and is not generally utilized in the tone pairs representative of data.

The DTMF tones are applied to driver 58, which as noted above, is also enabled (for a predetermined time period) by the signal from comparator 64. Driver 58 suitably comprises a PNP transistor 21 and NPN transistor Q3. The collector of transistor Q1 is connected to a positive supply voltage, and the emitter thereof connected to the negative terminal of winding 56. Feedback between emitter and base of transistor Q1 is provided through a capacitor C9. Transistor Q3 is connected to the positive supply through a resistor R9, while the collector thereof is connected to the base of transistor Q1, and to ground through a resistor R21, respectively. The base of transistor Q3 is connected through a resistor R18 to the positive supply and through a capacitor C7 to ground. The enable signal from timing circuit 30 is applied to the base of transistor Q3 through a resistor R20. The DTMF tones from DTMF encoder 78 are also applied to the base of transistor Q3 through a capacitor C8. The enable signal, in effect, causes transistor Q3 to be appropriately biased to pass the DTMF tones. The respective clock signals from clock signal generator 60 are such that the enable signal remains on for a predetermined period sufficient for outputting of the DTMF byte.

Thus, upon generation of the enable signal by comparator 64, analog-to-BCD generator 74 enters an output mode, and driver 58 is activated. DTMF encoder 78 thus generates a sequence of tone pairs respectively indicative of the sign and first, (tens), second (units) and third (tenths) BCD digits of the sample (sensed condition value). Each of the tone pairs is passed through driver 58 (and amplified) and applied in sequence to bus line 14. Thereafter, driver 58, in effect, times out, isolating DTMF encoder 78 from transformer T1. The respective time intervals programmed by switches 66 are chosen such that the next remote unit 12 in sequence would begin generation of the DTMF code byte representative of the condition sensed by its sensor device 34.

Figure 4:
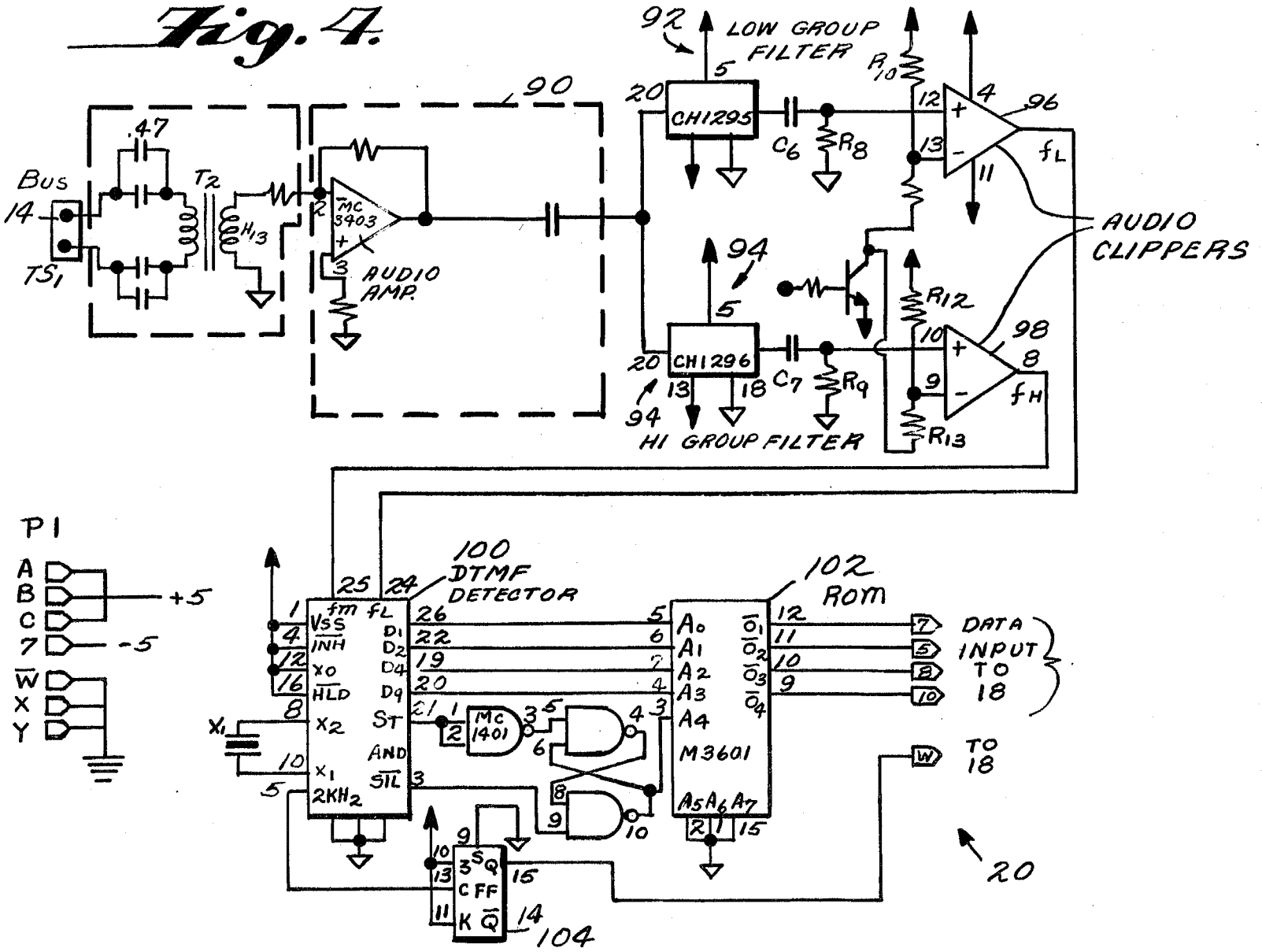
FIG. 4 is a schematic diagram of the micro-computer-bus interface.

The DTMF code signals are extracted from bus line 14 by bus interface 20. With reference now to FIG. 4, a suitable bus interface board will be described. Bus interface board 20 is coupled to bus line 14 through an iron core transformer T2 and appropriate DC blocking capacitors. The extracted DTMF code signals are suitably applied to an audio amplifier 90. The output of amplifier 90 is applied to respective high and low group filters 92 and 94, respectively, suitably commercially available Cermetek CH1295 and CH1296 chips. The filtered signals are applied through respective audio clippers 96 and 98 to a commercial DTMF detector 100 (DTMF to binary converter). Audio clippers 96 and 98 are periodically disabled in response to control signals from microprocessor 18, to provide spacing between the respective digits of the DTMF code in order to properly interface with various commercial DTMF detectors, such as, for example the Rockwell-Collins CRC8030. The DTMF detector provides a binary output indicative of the instantaneously applied tone pair in accordance with standard DTMF code conventions.

As noted above, where a non-standard code convention is adopted, the binary outputs of the commercial DTMF detector do not correspond to the binary outputs of the analog-to-BCD converter 74 in the remote unit. This is illustrated in Table I. Accordingly, the binary output of the commercial DTMF detector 100 must be converted into the adopted code. Such conversion is suitably accomplished by a conventional read only memory or lookup table 102, such as for example, a National M3601 chip. The output of ROM 102 is thus representative of the output of analog-to-BCD converter 74. The output signals of ROM 102 are thus applied to micro-processor 18 which stores them in memory and thereafter performs the above described comparison to the limit values.

It is also desirable to provide a sync signal to microprocessor 18. Such a sync signal is suitably derived from the crystal oscillator of the DTMF detector 100 by means of a flip-flop operating as a frequency divider 104. Further, if a non-variable data frame is utilized, i.e., the time interval between successive interruptions in the DC signal is not variable in accordance with the number of remote sensor units 12 actually in use, absent proper provision, it would be difficult to distinguish non-functioning sensors from those not being used in the system. Accordingly, if, during a given data byte period, no DTMF signals are received, DTMF detector 100 generates an appropriate signal, to, in effect, change the page of ROM 102 such that a predetermined output is generated by ROM 102 during the data byte. The locations in memory corresponding to the particular non-used unit are loaded with the predetermined value, accordingly no alarm is sounded. The predetermined value chosen is preferably outside of the range of normal sensor output values. On the other hand, where a remote unit 12 in use is non-functional and fails to generate a DTMF byte, the predetermined value generated by ROM 102 would be outside of the preset limits and an alarm would be sounded.

Figure 5:
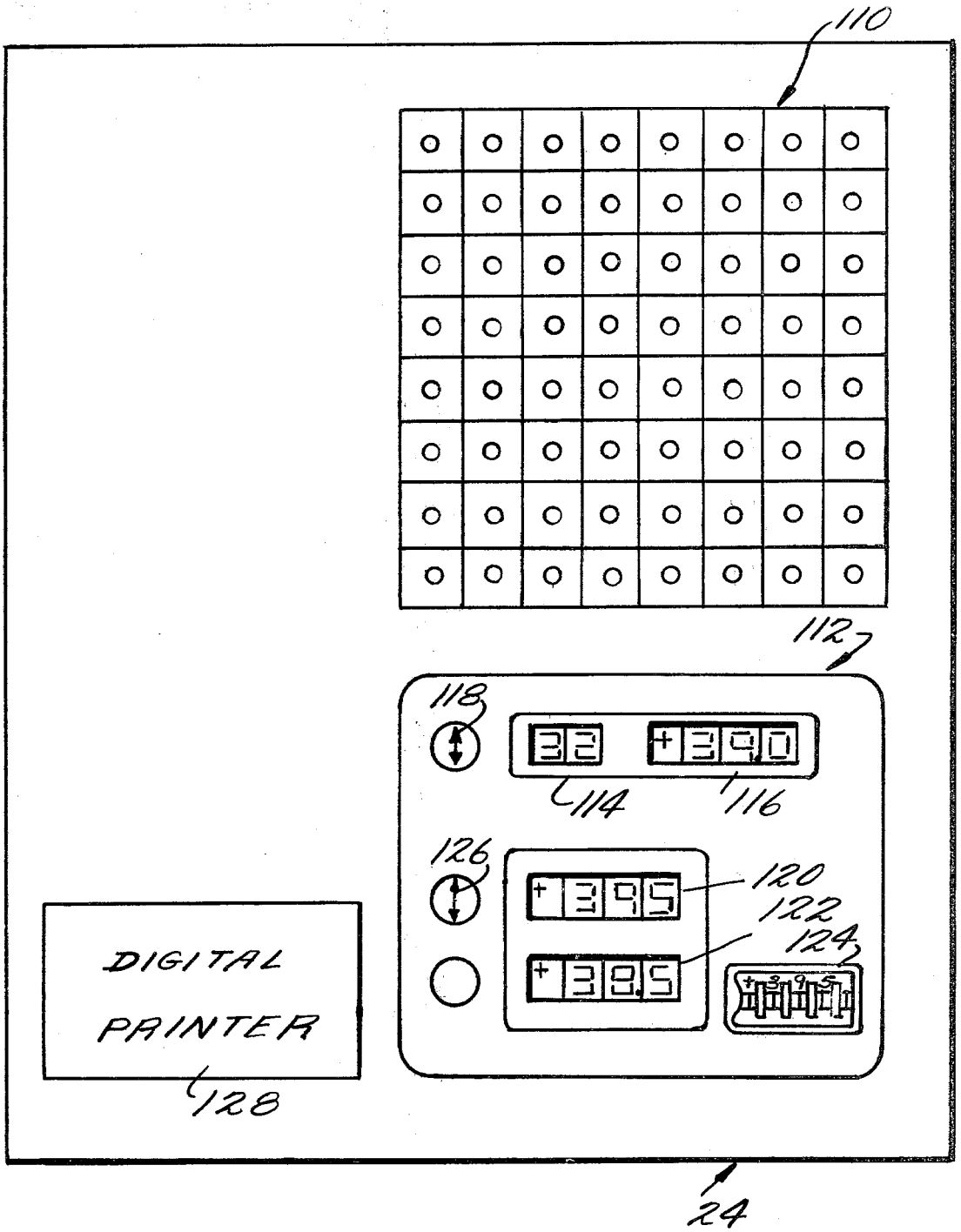
FIG. 5 is a pictorial illustration of the display of the central control unit.

With reference now to FIG. 5, the control panel/display 24 will be described. Control panel/display 24 includes a plurality of lights, hereinafter referred to as the alarm field 110. Each light corresponds to a given remote sensor unit 12, and is preferably so designated by a number or legend. As previously noted, the respective bytes representative of the remote sensor conditions are, in sequence, compared to high and low limit values previously loaded into assigned memory locations by the console operator. When the micro-processor detects that one of the various data bytes is not within the preset limit values, the light corresponding to that remote unit in alarm field 110 is energized and an audible alarm triggered.

In addition, to provide a selective monitoring capability and visual indication of values to the console operator, a field of digital displays (hereinafter referred to as a readout field 112) is provided. The readout field permits the operator to monitor the current value, and the high and low limits of any given remote sensor. Readout field 112 includes a unit number display 114 and unit condition display 116. A spring loaded two-positioned switch 118 is utilized to select a particular unit. A counter (not shown) cooperating with (and controlling) unit number display 114 is incremented once each time the switch is moved momentarily to an up position and decremented in response to a similar movement to the down position. Holding the spring loaded switch in either position will, after a predetermined delay time, cause the system to continually sequence in a direction in accordance with the switch position. The count representative of the unit number displays in unit number display 112 and is communicated to micro-processor 18, which in turn causes the contents of the memory location (corresponding to the latest sample from that unit) to be displayed on unit condition display 116.

The high and low limit values preset in the predetermined locations associated with the remote unit are displayed in digital displays 120 and 122.

Displays 114 and 116, 120 and 122 suitably comprise seven segment LCD or LED displays having an appropriate number of digits.

The setting of the high and low limits is accomplished through use of a digital thumb wheel switch 124 which is set to the desired limit value. A representative count is then loaded by micro-processor 18, into the high or low limit memory locations associated with the unit corresponding to the number displayed in unit display 114, in accordance with the position of a further spring loaded switch 126. Switch 126 is momentarily moved to the up position for setting the high limit value or to the down position for programming the low limit value. The high display 120 or low limit display 122 will change to the new value upon its entry into memory. It should be appreciated that during the initial set up of the system, both the high and low limits for each sensor are so entered into memory.

In addition, a digital printer 128 can be included within control panel/display 24 to provide a hard copy of the status of all sensors in the system. Digital printer 128 can be controlled by micro-processor 18 to provide periodic printouts in accordance with any desired format. Provisions for turning off the suitable alarm can also be included.

It should be noted that while various conductors shown interconnecting the elements of the drawing are shown in single lines, they are not so shown in a limiting sense and may comprise plural connections as is understood in the art. Further, it will be understood that the above description is of illustrative embodiments of the present invention, and that the invention is not limited to the specific form shown. Modifications may be made in the design and arrangement of the elements without departing from the spirit of the invention as set forth in the appended claims.

What is claimed is:

1. A multiplex sensor monitor system of the type including a central control unit connected to a plurality of remote sensor units through a two-wire bus line wherein each remote sensor unit comprises:

means, responsive to a signal indicative of a sensed condition and control signals applied thereto, for controllably generating onto said two-wire bus line a dual tone multifrequency (DTMF) indicative of said sensed condition;

means, for coupling said remote unit to said bus line and for deriving power for said remote sensor unit solely from a DC signal applied thereto over said two-wire bus line without the use of any battery or other local power source; and means, responsive to a reset signal applied thereto as an interruption of said D.C. signal, for generating a control signal to effect generation of said DTMF code signal after a respective predetermined time.

2. A multiplex sensor monitor system as in claim 1 wherein said central control unit comprises:

means, responsive to said code signals for providing indicia of said sensed conditions;

means for generating said DC signal to said remote sensor units; and means for periodically interrupting said DC signal to effect generation of said reset signal in each of said remote units, whereby the respective remote units generate respective DTMF code signals during sequential periods in accordance with said respective predetermined counts.

3. A multiplex sensor monitor system comprising in combination a central control unit, a two-wire bus line and a plurality of remote sensor units, said central control unit including:

a system power supply for generating a DC signal;

means for selectively applying said DC signal to said two-wire bus line such that said DC signal is periodically interrupted;

a memory having respective first and second memory locations corresponding to each of said remote sensor units;

means for loading said respective first and second memory locations with indicia of upper and lower value limits, respectively, associated with respective conditions sensed by said respective remote sensor units;

comparator means, respective of signals indicative of said respective upper and lower value limits and signals indicative of said respective conditions sensed by said respective remote sensor units, for generating an alarm signal when a sensed condition is of a value not between the upper and lower value limits associated therewith; and said remote sensor units each being powered by said DC signal, and comprising:

means for sensing a condition and responsive to a control signal applied thereto, selectively generating on said two-wire bus line a signal indicative of the value of said condition;

means, responsive to said DC signal, for generating a reset signal upon occurrence of said periodic interruption in said DC signal; and means responsive to said reset signal, for generating a control signal to effect generation on said two-wire bus line of said signal indicative of said condition at the end of a respective predetermined time interval after said reset signals, whereby signals indicative of said respective sensed conditions are transmitted to said central control unit on said bus line in a time multiplex manner.

4. The system of claim 3 wherein said means for sensing comprises a sensor device for generating an analog signal in accordance with the value of said condition, and means, responsive to said analog signal and said control signal, for generating a dual-tone multifrequency code signal indicative of said analog signal.

5. The system of claim 1 wherein said means for controllably generating a DTMF code signal comprises an analog-to-digital converter receptive of an analog signal representative of said sensed condition and a dual-tone multifrequency encoder responsive to the digital output signal of said analog-to-digital converter.

6. The system of claim 3 wherein said means for loading said respective first and second memory locations comprises a first selection means for generating a signal indicative of the addresses of the first and second memory locations associated with the condition sensed by said selected remote unit;

entry means, for generating a signal indicative of a desired limit value; and a switch for selectively routing said limit value signal to one of said first and second memory locations.

7. The system of claim 1 further comprising auxiliary display means, including means for coupling said auxiliary remote display means to said bus line.

8. The system of claim 1 further comprising means, connectable to a telephone system for automatically dialing a predetermined number of telephone numbers in a predetermined order and transmitting digital messages through said telephone system in response to said alarm signal.

9. The system of claim 1 wherein means for controllably generating a DTMF code signal on said two-wire bus line comprises:

analog-to-binary coded decimal (BCD) converter means, receptive of analog signals indicative of said sensed condition and control signals applied thereto, for sampling said analog signal and, responsive to an enable control signal, generating respective sequential output signals indicative of the respective digits of a BCD representation of said analog signal sample;

DTMF encoder means, responsive to input signals applied to first and second sets of input terminals, for generating a tone pair comprising a tone of a frequency chosen from a first group of frequencies in accordance with the input signals applied to said first set of input terminals, and a tone of a frequency chosen from a second group of frequencies in accordance with the input signals applied to said second set of input terminals; and a decoder interposed between said analog-to-BCD converter and said DTMF encoder for converting said respective sequential BCD output signals into input signals to said DTMF encoder means, to effect generation of DTMF tone pairs in accordance with a predetermined convention.

10. The system of claim 3 further comprising auxiliary display means, including means for coupling said auxiliary remote display means to said bus line.

11. The system of claim 3 further comprising means, connectable to a telephone system for automatically dialing a predetermined number of telephone numbers in a predetermined order and transmitting digital messages through said telephone system in response to said alarm signal.

12. A multiplex sensor monitor system of the type including a central control unit connected to a plurality of remote sensor units through a two-wire bus line wherein each remote sensor unit comprises:

means, responsive to a signal indicative of a sensed condition and control signals applied thereto, for controllably generating onto said two-wire bus line a dual tone multifrequency (DTMF) indicative of said sensed condition;

means, for coupling said remote unit to said bus line and for deriving power for said remote sensor unit from a DC signal applied thereto over said two-wire bus line; and means, responsive to a reset signal applied thereto, for generating a control signal to effect generation of said DTMF code signal after a respective predetermined time and also including entry means, for providing a programmable reference signal indicative of said respective predetermined time;

counter means, responsive to said reset signal, for accumulating an incremented count and generating a count signal indicative thereof; and comparator means, responsive to said reference signal and said count signal, for generating said control signal when said count signal equals said reference signal.

13. A multiplex sensor monitor system as in claim 12 wherein each remote sensor unit further includes:

means, coupled to said two-wire bus line for generating said reset signal in response to interruptions in said DC signal.

14. The system of claim 3 wherein said means responsive to a reset signal comprises:

entry means, for providing a programmable reference signal indicative of said respective predetermined time;

counter means, responsive to said reset signal, for accumulating an incremented count and generating a count signal indicative thereof; and comparator means, responsive to said reference signal and said count signal, for generating said control signal when said count signal equals said reference signal.

15. A multiplex sensor monitor system of the type including a central control unit connected to a plurality of remote sensor units through a two-wire bus line wherein each remote sensor unit comprises:

means, responsive to a signal indicative of a sensed condition and control signals applied thereto, for controllably generating onto said two-wire bus line a dual tone multifrequency (DTMF) indicative of said sensed condition;

means, for coupling said remote unit to said bus line and for deriving power for said remote sensor unit from a DC signal applied thereto over said two-wire bus line; and means, responsive to a reset signal applied thereto, for generating a control signal to effect generation of said DTMF code signal after a respective predetermined time;

said means for coupling said remote unit to said bus line including:

first and second windings, each having first and second terminals; the respective first terminals of said first and second windings being adapted for connection to the respective wires of said two-wire bus line;

the respective second terminals of said first and second windings being connected on either side of a capacitance, to develop a charge across said capacitance to supply power to said remote unit; and a third winding, inductively coupled to said first and second windings and electrically connected to said means for controllably generating said DTMF code signal, for communicating said DTMF code signal to said two-wire bus line.

16. A multiplex sensor monitor system as in claim 15 wherein each remote sensor unit further includes:

means, coupled to said two-wire bus line for generating said reset signal in response to interruptions in said DC signal.

* * * * *